US009042763B2

(12) United States Patent
Yamaguchi et al.

(10) Patent No.: US 9,042,763 B2
(45) Date of Patent: May 26, 2015

(54) IMAGE FORMING APPARATUS AND IMAGE FORMING SYSTEM WITH A QUOTA MANAGEMENT FUNCTION

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Hiroshi Yamaguchi, Shizuoka-ken (JP); Toshiyuki Sato, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 1 day.

(21) Appl. No.: 14/019,767

(22) Filed: Sep. 6, 2013

(65) Prior Publication Data

US 2015/0071673 A1 Mar. 12, 2015

(51) Int. Cl.
*G03G 15/00* (2006.01)
*G03G 15/26* (2006.01)

(52) U.S. Cl.
CPC ..... *G03G 15/50* (2013.01); *G03G 15/266* (2013.01)

(58) Field of Classification Search
USPC ..... 399/82, 79
See application file for complete search history.

(56) References Cited

U.S. PATENT DOCUMENTS

| | | | | |
|---|---|---|---|---|
| 5,289,230 | A * | 2/1994 | Hosoya et al. | 355/50 |
| 8,115,976 | B2 * | 2/2012 | Murakami | 358/498 |
| 2007/0229887 | A1 | 10/2007 | Nakagawa | |
| 2012/0189340 | A1 * | 7/2012 | Hagiwara | 399/82 |

OTHER PUBLICATIONS

Hiroshi U.S. Appl. No. 14/309,797, filed Jun. 19, 2014.*

* cited by examiner

*Primary Examiner* — Rodney Bonnette
(74) *Attorney, Agent, or Firm* — Amin, Turocy & Watson, LLP

(57) ABSTRACT

In accordance with one embodiment, an image forming apparatus includes an image forming section configured to form an image on the surface of a medium with a recording material the color of which cannot be erased by heating; a heating section configured to heat the medium to fix the image; and a control section configured to determine whether or not an executed job is a quota subtraction target job or a quota addition target job, calculate a corresponding subtraction quota when the job is a quota subtraction target job or a corresponding addition quota when the job is a quota addition target job, and update the current quota based on the subtraction quota and the addition quota.

10 Claims, 12 Drawing Sheets

150a

| USER NUMBER | USER NAME | USER PASSWORD |
|---|---|---|
| 00001 | User1 | 11111 |
| 00002 | User2 | 22222 |
| 00003 | User3 | 33333 |
| •••• | •••• | •••• |

FIG.8

150b

| USER NUMBER | USER NAME | PRINT | SCAN | FAX | BOX | COLOR ERASING |
|---|---|---|---|---|---|---|
| 00001 | User1 | ✓ | | | | ✓ |
| 00002 | User2 | | ✓ | ✓ | ✓ | ✓ |
| 00003 | User3 | | ✓ | | | |
| •••• | •••• | •••• | •••• | •••• | •••• | |

FIG.9

150c

| USER NUMBER | USER NAME | INITIAL VALUE | ACCUMULATED SUBTRACTION VALUE | ACCUMULATED ADDITION VALUE | CURRENT VALUE |
|---|---|---|---|---|---|
| 00001 | User1 | | | | |
| 00002 | User2 | | | | |
| 00003 | User3 | | | | |
| •••• | •••• | •••• | •••• | •••• | •••• |

WEIGHTING SETTING TABLES FOR SUBTRACTION IN QUOTA MANAGEMENT

| COLOR | WEIGHTING SETTING |
|---|---|
| PRINT | |
| COLOR | 1.0 |
| TWO COLORS | 2.0 |
| MONO-COLOR | 2.0 |
| FULL COLOR | 4.0 |
| SCAN | |
| MONO-COLOR | 0.1 |
| FULL COLOR | 0.2 |

150d

| SIZE | WEIGHTING SETTING |
|---|---|
| PRINT | |
| SMALL | 1.0 |
| LARGE | 2.0 |
| Long A | 4.0 |
| Long B | 8.0 |

150e

| MEDIUM TYPE | WEIGHTING SETTING |
|---|---|
| PRINT | |
| THICKNESS 1 | 2.0 |
| THICKNESS 2 | 3.0 |
| SPECIFIC PAPER 1 | 2.0 |
| SPECIFIC PAPER 2 | 3.0 |
| ENVELOPE | 1.5 |
| TAB | 2.0 |

150f

150g

| FAX | WEIGHTING SETTING |
|---|---|
| SEND | 1.0 |
| RECEIVE | 0 |

| BOX | WEIGHTING SETTING |
|---|---|
| STORE | 0 |
| TAKE OUT | 0 |

150h

WEIGHTING SETTING TABLES FOR ADDITION IN QUOTA MANAGEMENT

| ERASING REUSABLE PAPER | WEIGHTING SETTING |
|---|---|
| SMALL | 1.0 |
| LARGE | 2.0 |

150j

| COLOR ERASABLE TONER | WEIGHTING SETTING |
|---|---|
| TYPE A | 1.0 |
| TYPE B | 1.5 |

150k

FIG.10

IMAGE FORMING APPARATUS AND IMAGE FORMING SYSTEM WITH A QUOTA MANAGEMENT FUNCTION

FIELD

Embodiments described herein relate to an image forming apparatus and an image forming system.

BACKGROUND

As one form of an image forming apparatus, there is a MFP (Multi-Function Peripheral) which is a digital multi-function peripheral having a plurality of functions such as a scanner function, an FAX function and an image data storage function in addition to a copy function.

Conventionally, a counter management and a quota management are carried out to manage the use cost of an image forming apparatus. The counter management is a method of cost management using a count on the use of an image forming apparatus, such as the number of the sides printed by the image forming apparatus or the number of copies, as an index. The quota management is a management method of limiting the use times of an image forming apparatus, such as the number of sides printed by the image forming apparatus and the number of copies.

However, among the management methods, a method is being sought which is more effective in corresponding use environments.

An image forming apparatus is provided which comprises an image forming section configured to form an image on a surface of a medium with a recording material the color of which cannot be erased by heating; a heating section configured to heat the medium to fix the image; a job determination section configured to determine whether a completed job is a quota subtraction target job or a quota addition target job; an addition and subtraction quota calculation section configured to calculate a corresponding subtraction quota when the job is a quota subtraction target job or a corresponding addition quota when the job is a quota addition target job; and a quota update section configured to update the current quota based on the subtraction quota and the addition quota.

BRIEF DESCRIPTION OF THE DRAWINGS

FIG. 8 is a diagram illustrating the content of a function management database in an image forming apparatus according to the first embodiment;

FIG. 9 is a diagram illustrating the content of an allotment management database in an image forming apparatus according to the first embodiment;

FIG. 10 is a diagram exemplarily illustrating the content of weighting setting tables in an image forming apparatus according to the first embodiment;

DETAILED DESCRIPTION

A First Embodiment

Figure 1:
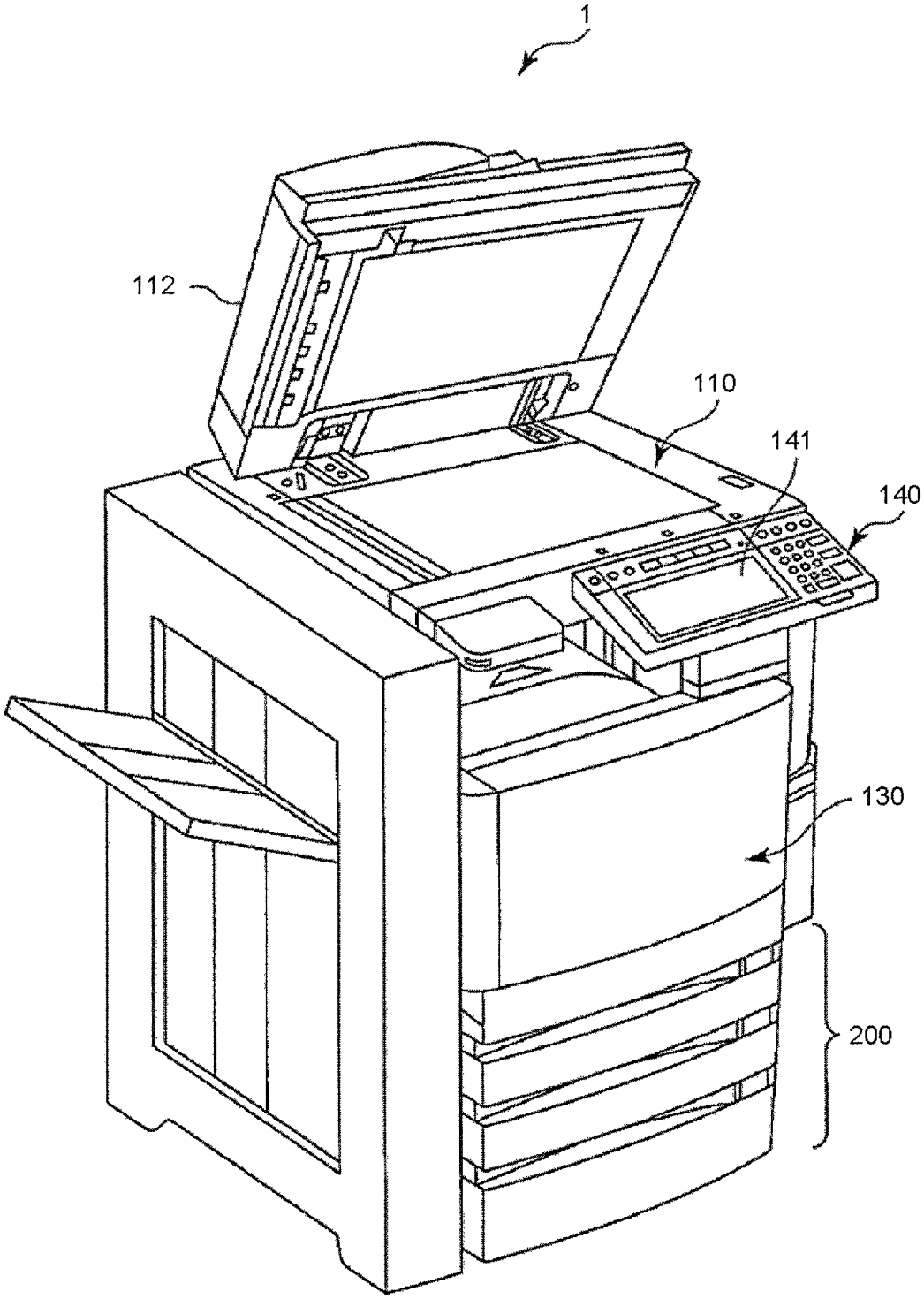
FIG. 1 is a perspective view illustrating a schematic shape of an image forming apparatus according to a first embodiment.

FIG. 1 is a perspective view illustrating a schematic shape of an image forming apparatus according to a first embodiment.

An image forming apparatus 1 is provided with a printing section 130, a paper tray 200, a scanning section 110, an auto feed section 112 and a control panel 140.

The printing section 130 outputs image information as an output image which is called as, for example, a hard copy or printout. The paper tray 200 supplies an output medium serving as papers of various sizes used in an image output to the printing section 130. The scanning section 110 acquires image information from an original as image data. The auto feed section 112 feeds a read original from a reading position to a discharging position and guides a next original to the reading position. The control panel 140 is an instruction input section for instructing the operations of the image forming apparatus 1, such as the starting of an image forming operation in the printing section 130 or the starting of an original image information reading operation of the scanning section 110. A display section 141 for inputting an instruction and displaying information for an operator is arranged on the control panel 140.

Figure 2:
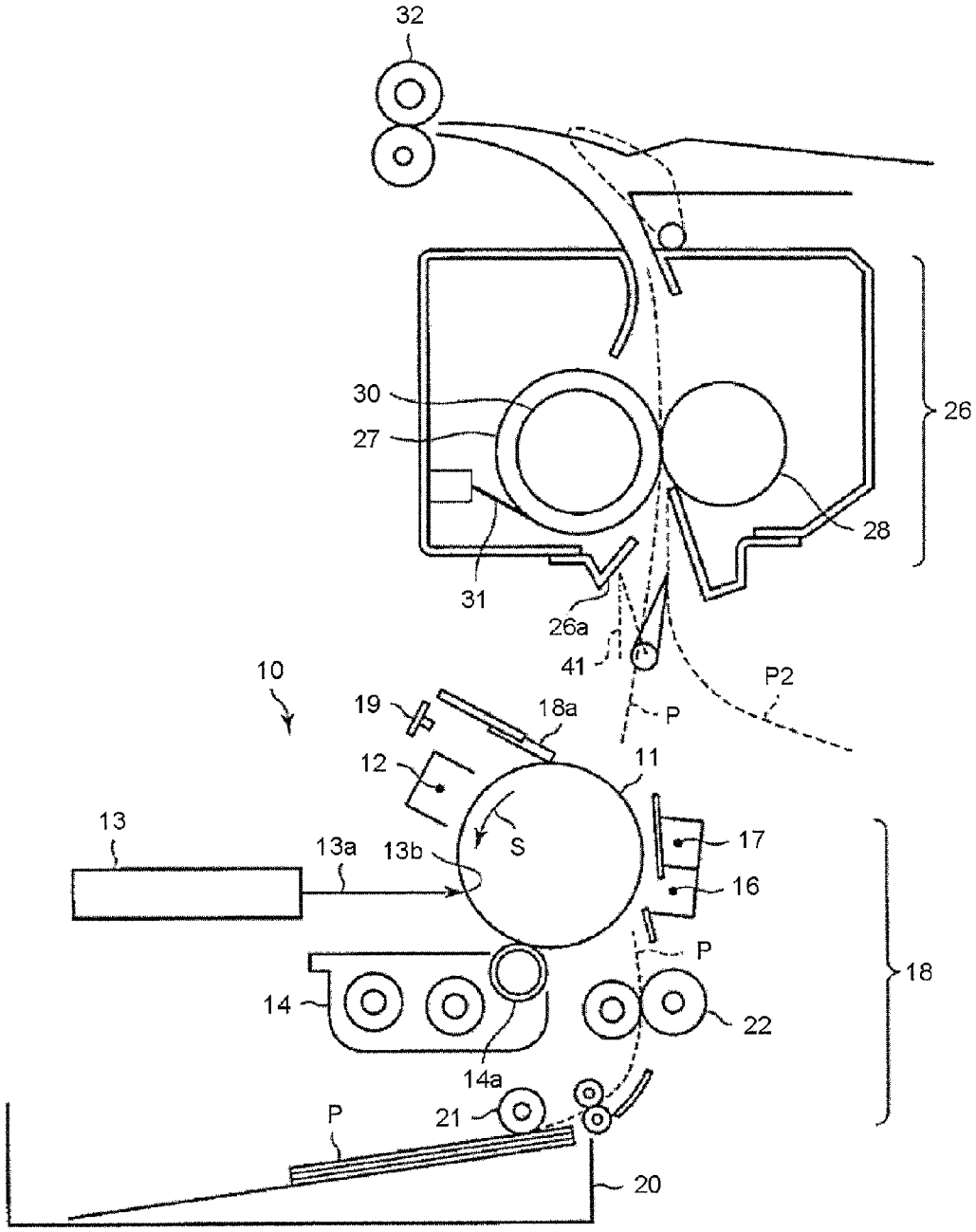
FIG. 2 is a diagram illustrating a constitution of an image forming section and a fixing apparatus of an image forming apparatus according to the first embodiment.

FIG. 2 is a diagram illustrating a constitution of an image forming section 10 and a fixing apparatus 26 of the image forming apparatus according to the first embodiment. The image forming apparatus 1 described in the first embodiment forms an image with a toner (recording material) the color of which is erased by heating. Further, the image forming apparatus 1 has a function of erasing a toner image.

A photoconductive drum 11 of the image forming section 10 has an organic photo conductor (OPC) on the surface of a supporting member having a diameter $\phi$ of 60 mm. The photoconductive drum 11 is driven in a direction indicated by an arrow s at a first paper conveyance speed, that is, a circumferential speed of 215 mm/sec. A charging charger 12, a laser exposure apparatus 13, a developing apparatus 14, a transfer charger 16, a peeling charger 17, a cleaner 18 having a cleaning blade 18*a* and a charge removing LED 19 are arranged around the photoconductive drum 11.

The photoconductive drum 11 is charged uniformly with −750v by the charging charger 12 according to the rotation of the photoconductive drum 11. The laser exposure apparatus 13 irradiates a laser light 13*a* corresponding to image information to an irradiation position 13*b* on the charged photoconductive drum 11.

A paper P serving as a recording medium is taken out from a paper feed cassette apparatus 20 by a paper feed roller 21. The paper P is conveyed to the transfer charger 16 of the image forming section 10 via a register roller 22 at the same time when a toner image is formed on the photoconductive drum 11. An unfixed toner image is formed on the paper P by the image forming section 10 with a color erasable toner. The paper feed cassette apparatus 20 is capable of feeding an unused paper or a paper for reuse.

The fixing apparatus 26 is arranged above the image forming section 10. The fixing apparatus 26 heats and pressurizes the paper P serving as a recording medium to fix an image. The fixing apparatus 26 has a fixing roller 27 serving as a fixing rotator and a pressing roller 28 serving as a pressing rotator pressed against the fixing roller 27. Further, the fixing apparatus 26 comprises an entrance guide 26*a* for guiding the paper P to a nip between the fixing roller 27 and the pressing roller 28.

The fixing roller 27 is formed by coating PTFE (Polytetrafluoroethylene) on the surface of a hollow cylindrical cylinder made from iron. The fixing roller 27 has an internal IH coil (induction heating coil) 30. The fixing roller 27 is inductively heated directly from the inside. The surface temperature of the fixing roller 27 is detected by a thermistor 31. The current of the IH coil 30 is controlled according to the output of the thermistor 31, and the surface temperature of the fixing roller 27 is controlled to be a specific temperature.

The pressing roller 28 is formed by forming an elastic layer including foamed silicone sponge rubber on a metal shaft and covering the surface with a PFA (the copolymer of tetrafluoroethylene and perfluoroalkyl vinyl ether) tube. Measured by an ASKER-C, the hardness of the pressing roller 28 is about 55 degrees. The pressing roller 28 obtains, through the elastic layer, a nip having a width of about 6 mm, thereby achieving a low heat capacity for an energy-saving fixation.

A paper discharging roller 32 is arranged at a position more downstream than the fixing apparatus 26 along the conveyance direction of the paper P to discharge the fixed paper P to a given direction.

Figure 3:
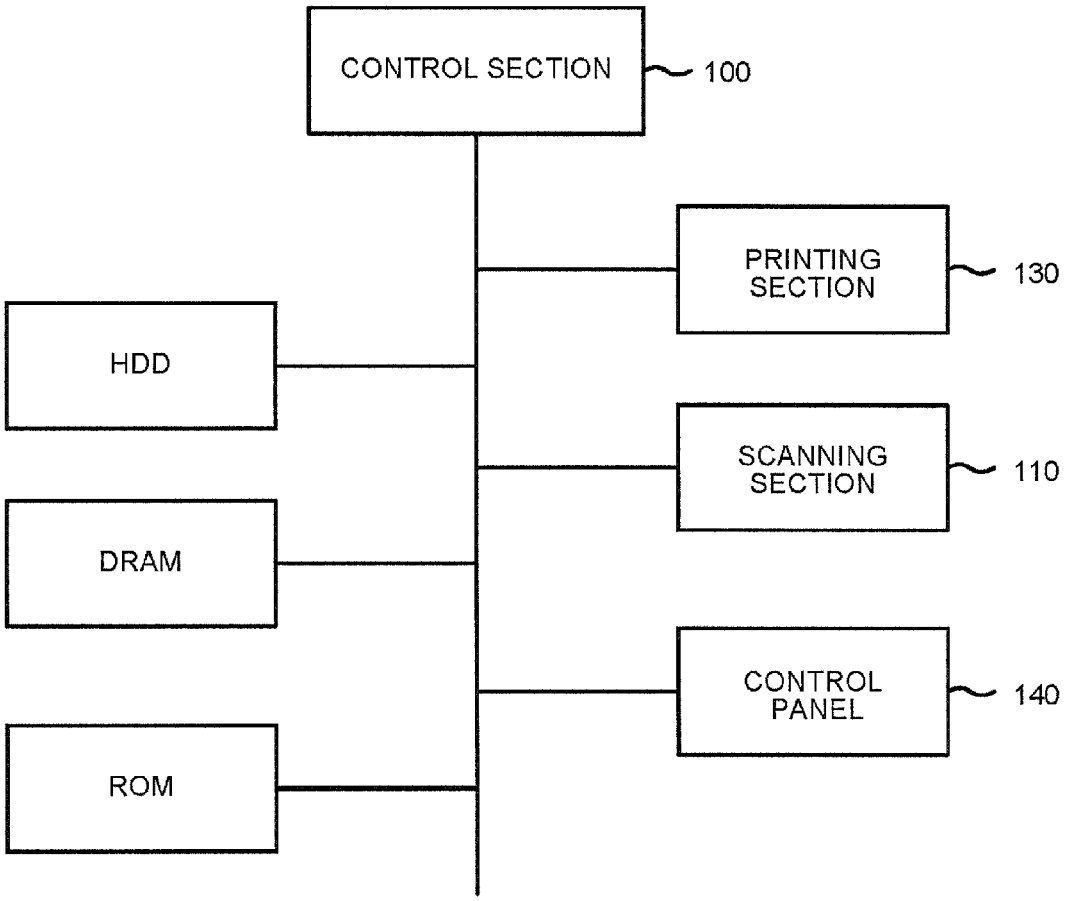
FIG. 3 is a block diagram illustrating a constitution of the control system of an image forming apparatus according to the first embodiment.

FIG. 3 is a block diagram illustrating a constitution of the control system of the image forming apparatus 1 according to the first embodiment.

In addition to the aforementioned printing section 130, scanning section 110 and control panel 140, the image forming apparatus 1 further comprises a control section 100, a ROM, a DRAM and an internal storage apparatus (HDD). Moreover, the aforementioned sections are all connected via a system bus line.

The control section 100 controls each section connected via the system bus line. Various control programs required to operate the image forming apparatus 1 are stored in the ROM. Programs for controlling an image forming operation and an image erasing operation which will be described later are stored in the ROM. The execution of each program is controlled by the control section 100. The DRAM is a buffer memory for temporarily storing data generated when each program is executed.

Next, the image formation process carried out by the image forming apparatus 1 is described.

The photoconductive drum 11 which rotates in the direction indicated by the arrow s in the image forming section 10 when an image formation process is started is charged uniformly with −750v by the charging apparatus 12.

Then, the laser exposure apparatus 13 irradiates a laser light corresponding to image information to the photoconductive drum 11 to form an electrostatic latent image. Sequentially, the electrostatic latent image is developed by the developing apparatus 14 with a color erasable toner to form, on the photoconductive drum 11, a toner image with a capsule color erasable toner which has a characteristic of being erased instantly by heating compared with conventional toners.

On the other hand, a paper P is fed from the paper feed cassette apparatus 20. The paper P is conveyed to the transfer charger 16 by the register roller 22 in synchronization with the formation of a toner image on the photoconductive drum 11 so as to transfer the toner image on the photoconductive drum 11.

After being peeled from the photoconductive drum 11, the paper P transferred with the toner image is conveyed to the fixing apparatus 26. Further, the surface temperature of the fixing roller is controlled to be 140 degrees centigrade. The paper P is inserted through the space between the fixing roller 27 and the pressing roller 28 to heat, pressurize and fix the toner image. As the fixing roller 27 and the pressing roller 28 are formed in a reverse crown shape, it is guaranteed that two end parts of the paper P are drawn earlier than the center part of the paper P when the paper P is inserted into the nip between the fixing roller 27 and the pressing roller 28. As the paper P is heated, pressurized and fixed while being pulled from the center part to the end parts due to the reverse crown shape of the pressing roller 28, the generation of a crumple is prevented. After the toner image formed with the capsule color erasable toner is fixed by the fixing apparatus 26, the paper P is discharged to a given direction by the paper discharging roller 32.

After the transfer is completed, the photoconductive drum 11 removes the residual toner using the cleaner 18 and the residual charges using the charge removing LED 19, and then the image formation process is ended.

Figure 4:
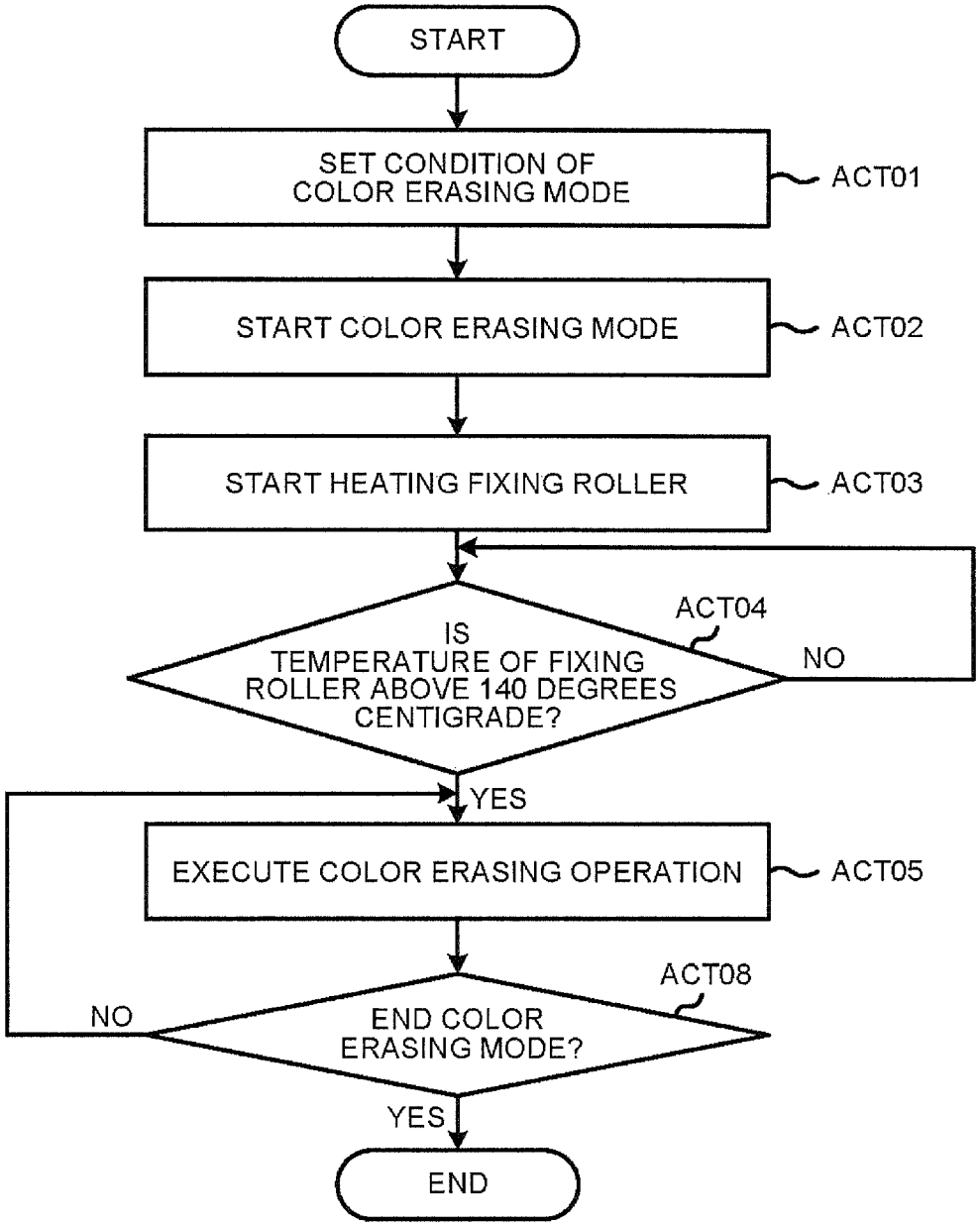
FIG. 4 is a flowchart illustrating an image erasing operation of an image forming apparatus according to the first embodiment.

FIG. 4 is a flowchart illustrating an image erasing operation of the image forming apparatus 1 according to the first embodiment.

Further, the following operations are executed by the control section 100 of the image forming apparatus 1.

A paper P, on which an image is formed with a capsule color erasable toner, is placed in the paper feed cassette 20 to be reused after the toner image on the used paper P is erased. A user executes an image erasing operation. A paper P formed with an image may also be placed in a specific cassette apparatus 20 or a manual feeding apparatus.

In ACT 01, a user sets, from the control panel 140, a condition of a color erasing mode.

Figure 5:
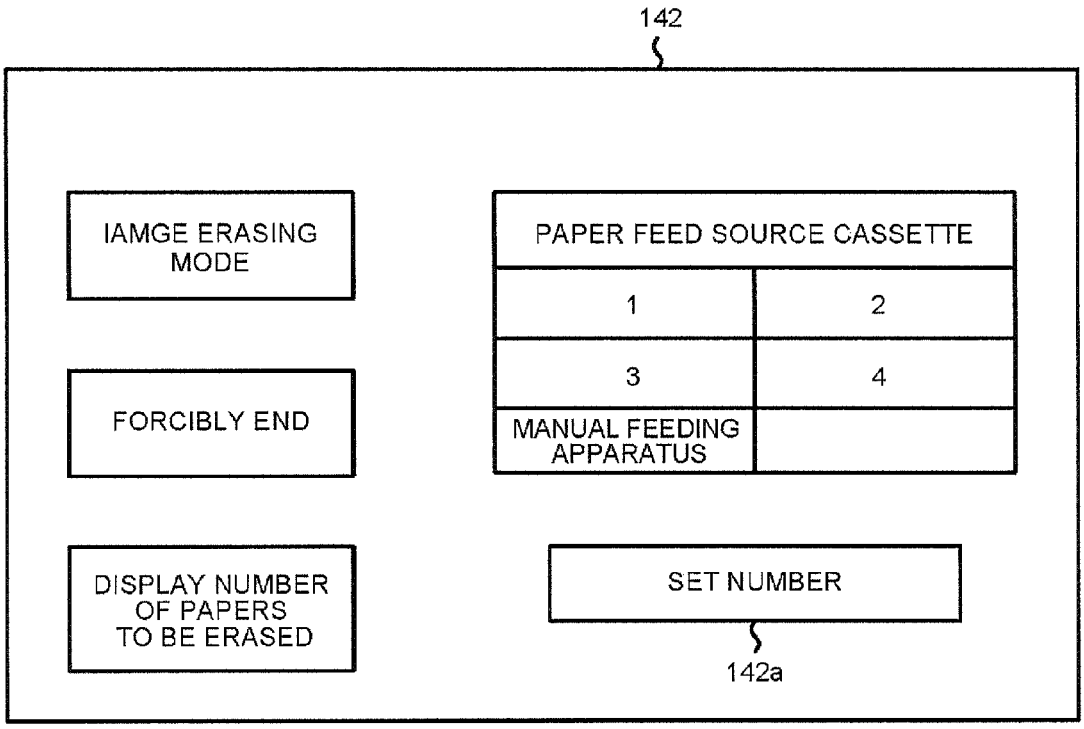
FIG. 5 is a diagram illustrating an image erasing operation screen displayed on a control panel according to the first embodiment.

FIG. 5 is a diagram illustrating an image erasing operation screen 142 displayed on the control panel 140 according to the first embodiment.

A user presses a button of image erasing mode on the image erasing operation screen 142 and designates, from cassettes 1 to 4 and a manual feeding apparatus, a cassette for storing a paper P for reuse as a paper feed source cassette. Herein, a plurality of cassettes, but not limited to one cassette, may be designated as a paper feed source cassette at the same time. The user sets the number of the papers to be erased. A numeric string, if input by the user from a keyboard 170*d*, is displayed in a number setting column 142*a*.

Then, once the user presses a start button arranged on the operation section 170 of the control panel 140, a color erasing mode (color erasing operation) is started in ACT 02. Further, the image erasing operation screen 142 may be formed by combining an operation button for image erasing with conventional operation screen, but is not limited to the constitution above. Further, it may be also set that a cassette is not designated, and a paper P for reuse can be taken out from a specific cassette.

In ACT 03, the heating of the fixing roller 27 is started. In the first embodiment, the image forming apparatus 1 executes an image forming operation with a color erasable toner or an ordinary (color-inerasable) toner. Thus, in a printing mode (printing operation), the temperature of the fixing roller is controlled to be below 100 degrees centigrade, for example, a set temperature of 80 degrees centigrade, but not above a toner image erasing temperature of 90 degrees centigrade.

Thus, in ACT 04, the fixing roller is heated to above 140 degrees centigrade so as to erase a color erasable toner. Then, if the temperature of the fixing roller, is above 140 degrees centigrade (YES in ACT 04), the flow proceeds to ACT 05 to executes a color erasing operation.

In an image erasing mode, no electrostatic latent images corresponding to the image information are formed on the photoconductive drum 11 by the laser exposure apparatus 13. That is, a paper P is conveyed to the fixing apparatus 26 in the line the same as that for the aforementioned image formation.

In the image erasing mode, the fixing apparatus 26 conveys a paper while heating and pressurizing the paper to fix. At this time, the surface temperature of the fixing roller 27 is also 140 degrees centigrade. The toner image on the paper is erased by heating the paper due to the instant erasing characteristic of the capsule color erasable toner when heated to a temperature of above 90 degrees centigrade.

In ACT 08 shown in FIG. 4, whether or not to end the color erasing mode is checked. For example, the color erasing mode is ended if a given number of mediums are erased. Further, the color erasing mode is ended when there is no medium in a designated paper feed source cassette (the paper feed source cassette is empty) even if the erasing operation of a given number of mediums is not finished.

If it is checked not to end the color erasing mode (NO in ACT 08), the flow returns to ACT 05 to execute a color erasing operation. If a condition for ending the color erasing mode is met (YES in ACT 08), the color erasing mode is ended in ACT 09.

Next, a quota management method according to the first embodiment is described.

In an output management using a quota according to the first embodiment, the value of a quota (allotment) to be used in a given period of time is set for each user and each department. The quota for the user and the department is subjected to an addition or subtraction operation during the execution process of a job according to the number of the sides of a paper used in the job or the times the job is executed. Then, an alarm is given when the quota is 0, or the execution of the job is disenabled.

In this case, a quota subjected to a subtraction operation corresponding to the content of a job is weighted. For example, a quota is set according to the category of a job (copy, print, scan or erase color), the size of a paper (A3, A4), the type of printing colors (color, monochrome) and the type of a paper (a paper having a basis weight or a specific paper).

Figures 6, 7:
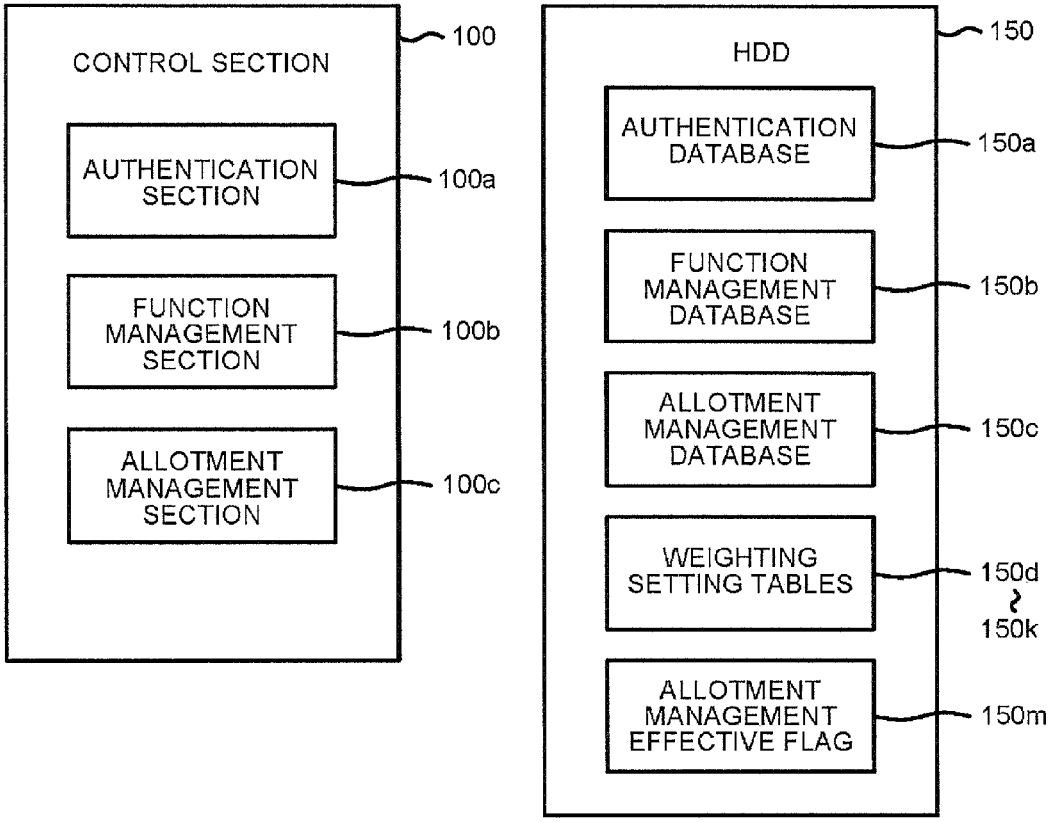
FIG. 6 is a diagram illustrating a constitution relating to a quota management in an image forming apparatus according to the first embodiment.
FIG. 7 is a diagram illustrating the content of an authentication database in an image forming apparatus according to the first embodiment.

FIG. 6 is a diagram illustrating a constitution relating to a quota management in the image forming apparatus according to the first embodiment.

An authentication section 100*a*, a function management section 100*b* and an allotment management section 100*c* are arranged in the control section 100 to execute a quota management. An authentication database 150*a*, a function management database 150*b*, an allotment management database 150*c*, weighting setting tables 150*d*-150*k* and an allotment management effective flag 150*m* are arranged in the HDD 150 as databases relating to a quota management.

The authentication section 100*a* authenticates the user logged in to the image forming apparatus 1. That is, the authentication section 100*a* permits the use of the image forming apparatus 1 by a user if the user name and the password input by the user logging in are the same as those registered in the authentication database 150*a*.

The function management section 100*b* manages whether or not a user has a right of using the respective functions of the image forming apparatus 1 for each user. The function management section 100*b* changes the right according to the set operation of the manager of the image forming apparatus 1. That whether or not a user has a right is stored in the function management database 150*b*.

The allotment management section 100*c* adds or subtracts a quota according to a set weighting such as a job category, a color type and a size for the used job for a user, stores and manages the result. A quota for a user is stored in the allotment management database 150*c*. A weighted quota is stored in the weighting setting tables 150*d*-150*h*. Information of whether or not to carry out a quota management in the image forming apparatus 1 is stored in the allotment management effective flag 150*m*. That is, in the present embodiment, whether or not to carry out a quota management in the whole image forming apparatus is specified.

FIG. 7 is a diagram illustrating the content of the authentication database in the image forming apparatus according to the first embodiment. The authentication database 150*a* is a database dedicated for user authentication. An association of a user represented by 'user number', 'user name' and the like with 'user password' serving as authentication information is registered in the authentication database 150*a*.

FIG. 8 is a diagram illustrating the content of the function management database in the image forming apparatus according to the first embodiment. An association of a user represented by 'user number', 'user name' and the like with a function allotted to the user is registered in the function management database 150*b*. Further, the mark in the table represents an allotted function. That is, a user cannot use the function corresponding to a blank column.

Allocated functions include 'PRINT', 'SCAN', 'FAX, 'BOX', 'ERASE COLOR' and the like. Herein, the erasing function refers to erasing a paper using a fixing apparatus according to, for example, the flow shown in FIG. 4.

In the example shown in FIG. 8, functions 'PRINT' and 'ERASE COLOR' are allotted to 'user 1'. Functions 'SCAN', 'FAX', 'BOX' and 'ERASE COLOR' are allotted to 'user 2'. A function 'SCAN' is allotted to 'user 3'.

Further, the authentication database 150*a* and the function management database 150*b* are not necessarily independent from each other and can also be combined into one integrated database.

FIG. 9 is a diagram illustrating the content of the allotment management database in the image forming apparatus according to the first embodiment. In the allotment management database 150*c*, data for a quota management is set for each user represented by 'user number', 'user name' and the like.

'Initial value' is a quota value set at the starting time (for example, a given date in every month) of a quota management. 'Accumulated subtraction value' is an accumulated value of the quota value subtracted in each job from the starting time. 'Accumulated addition value' is an accumulated value of the quota value added in each job from the starting time. 'Current value', which is calculated by adding 'accumulated addition value' to the difference between the 'initial value' and the 'accumulated subtraction value', is the quota currently owned by the user.

FIG. 10 is a diagram exemplarily illustrating the content of the weighting setting tables in the image forming apparatus according to the first embodiment. The weighting setting tables are set in advance for each user, and the manager of the image forming apparatus sets weighting values.

The weighting setting tables include weighting setting tables for subtraction and weighting setting tables for addition. The weighting setting tables for subtraction include a color setting table 150*d*, a size setting table 150*e*, a medium type setting table 150*f*, a FAX setting table 150*g* and a BOX setting table 150*h*. The weighting setting tables for addition include a reusable paper color erasing setting table 150*j* and a color erasable toner setting table 150*k*.

As to the weighting setting tables for subtraction, in the color setting table 150*d*, the weighting value set for full color is greater than that set for black. In the size setting table 150*e*, the weighting value set for a small sized paper (e.g. smaller than A4) is greater than that set for a larger sized paper (e.g. larger than A3). In the medium type setting table 150*f*, the thicker the paper is, the greater the weighting setting value is.

In the FAX setting table 150*g*, the weighting set for 'send' is 1.0, and the weighting set for 'receive' is 0. As stated in the following description, no quota management is carried out for a job when the set weighting is 0. In the BOX setting table 150*h*, the weightings for 'store' and 'take out' are both set to 0. Therefore, BOX function is excluded from the target of a quota management.

As to the weighting setting tables for addition, in the reusable paper color erasing setting table 150*j*, as the larger a reusable paper is, the greater the contribution to ecology is, therefore, a greater weighting value is set for a paper of a larger size. In the color erasable toner setting table 50*k*, as the lower the color erasing temperature of a toner is, the more effective the energy-saving is, therefore, a greater weighting value is set for a color erasable toner lower in color erasing temperature according to the categories of color erasable toners.

Next, an embodiment of a quota management method is described.

Subtraction is described first. For example, a user has a quota of 100. When the user carries out a monochrome printing on four pages of A4 sized paper, according to a weighting, a quota of 4 (1*1*4) is subtracted from 100. Then, the quota for the user becomes 96. The user further carries out a full-color printing on four pages of A3 sized paper, according to a weighting, a quota of 32 (4*2*4) is subtracted from 96. Then, the quota for the user becomes 64.

When the user sends four pages by FAX, according to a weighting, a quota of 4 (4*1) is subtracted from 64. Then, the quota for the user becomes 60. When the use receives four pages by FAX, according to a weighting, a quota of 0 (4*0) is subtracted from 60. Then, the quota for the user is unchanged and is still 60. Therefore, no quota management is carried out when the weighting is 0.

Then, addition is described. For example, when the user erases 10 pages of erasable prints of A4 size, according to a weighting, a quota of 10 (1*10) is added to 60. Then, the quota for the user becomes 70. Further, when the user carries out a monochrome printing on 4 pages of A4 sized papers with the color erasable toner of type B, according to the weighting obtained from the addition based on the use of the color erasable toner and the subtraction based on printing, a quota of 2 (1.5×4−1×1×4) is calculated and then added to 70. Then, the quota for the user becomes 72.

Thus, attentions should be paid to the synchronous calculation of a subtraction and an addition for a job in a quota management.

Figure 11:
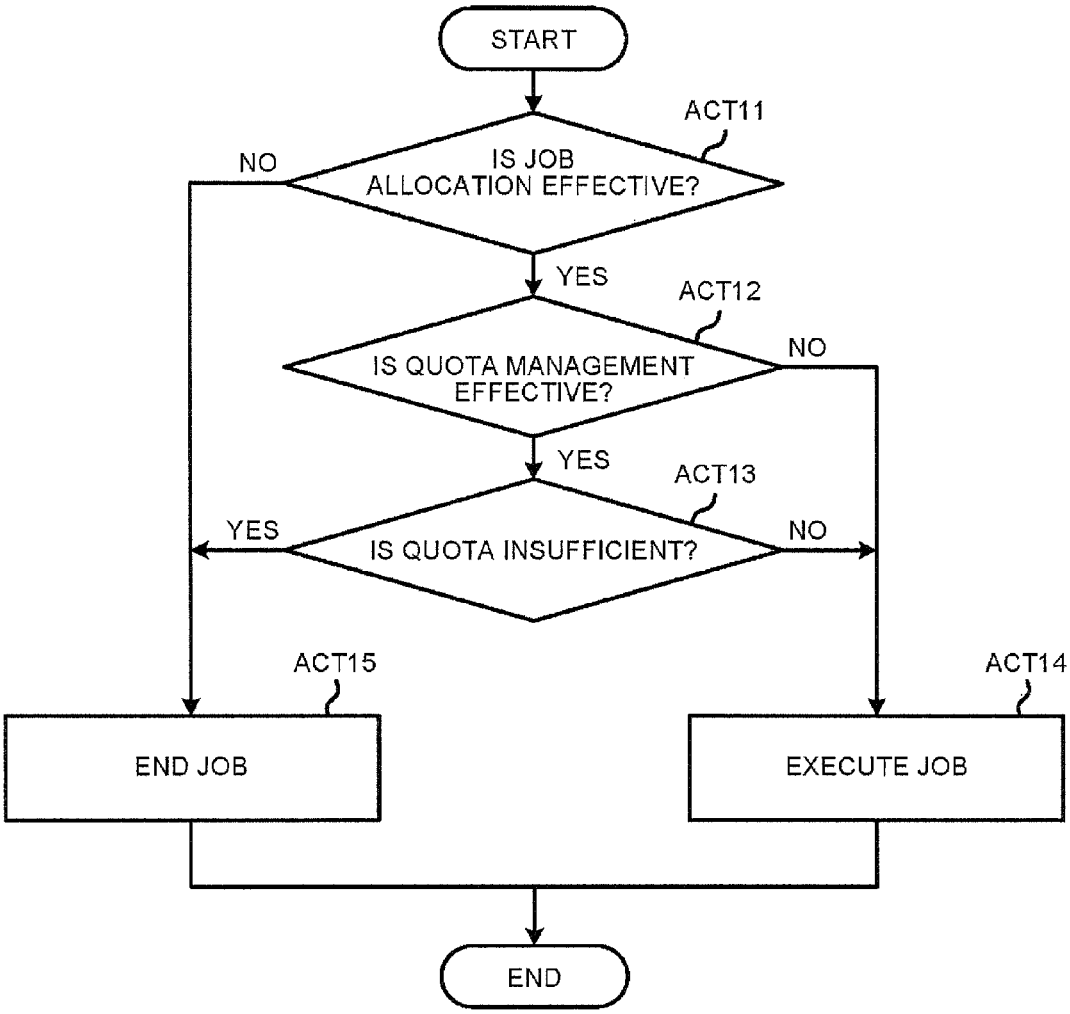
FIG. 11 is a flowchart illustrating a quota management operation carried out by an image forming apparatus when a job execution instruction is input according to the first embodiment.

FIG. 11 a flowchart illustrating a quota management operation carried out by the image forming apparatus when a job execution instruction is input according to the first embodiment.

When a job execution instruction is input, the control section 100 determines whether or not a job allocation for a user is effective in ACT 11. The control section 100 determines, with reference to the function management database 150*b*, that the job allocation is effective for the user if at least one subtraction function is effective (marked by J).

When the job allocation is not effective (NO in ACT 11), the input job is ended in ACT 15. When the job allocation is effective (YES in ACT 11), the control section 100 determines whether or not a quota management is effective in ACT 12.

In the image forming apparatus described in the first embodiment, no quota management is carried out for each single job, and it is set whether or not to carry out a quota management for all jobs of the image forming apparatus.

By accessing the image forming apparatus 1 with a processing terminal such as a PC (personal computer), the manager of the image forming apparatus 1 can overwrite the various setting tables in the image forming apparatus through a displayed setting screen (not shown). The setting tables include the authentication database 150*a*, the function management database 150*b*, the allotment management database 150*c*, the weighting setting tables 150*d*-150*k* and the allotment management effective flag 150*m*.

The manager can set a quota management for all jobs of the image forming apparatus by inputting information 'effective' in the allotment management effective flag 150*m*.

In ACT 12, the control section 100 determines whether or not a quota management is effective with reference to the allotment management effective flag 150*m*. When the quota management is not effective (NO in ACT 12), the input job is executed in ACT 14. When the quota management is effective (YES in ACT 12), in ACT 13, the control section 100 determines whether not a quota is insufficient in executing the job. The determination can be made by calculating quota in advance according to a job execution condition input to the control panel 140.

When the quota is not insufficient (NO in ACT 13), the input job is executed in ACT 14. When the quota is insufficient (YES in ACT 13), the control section 100 ends the execution of the job in ACT 15.

Figure 12:
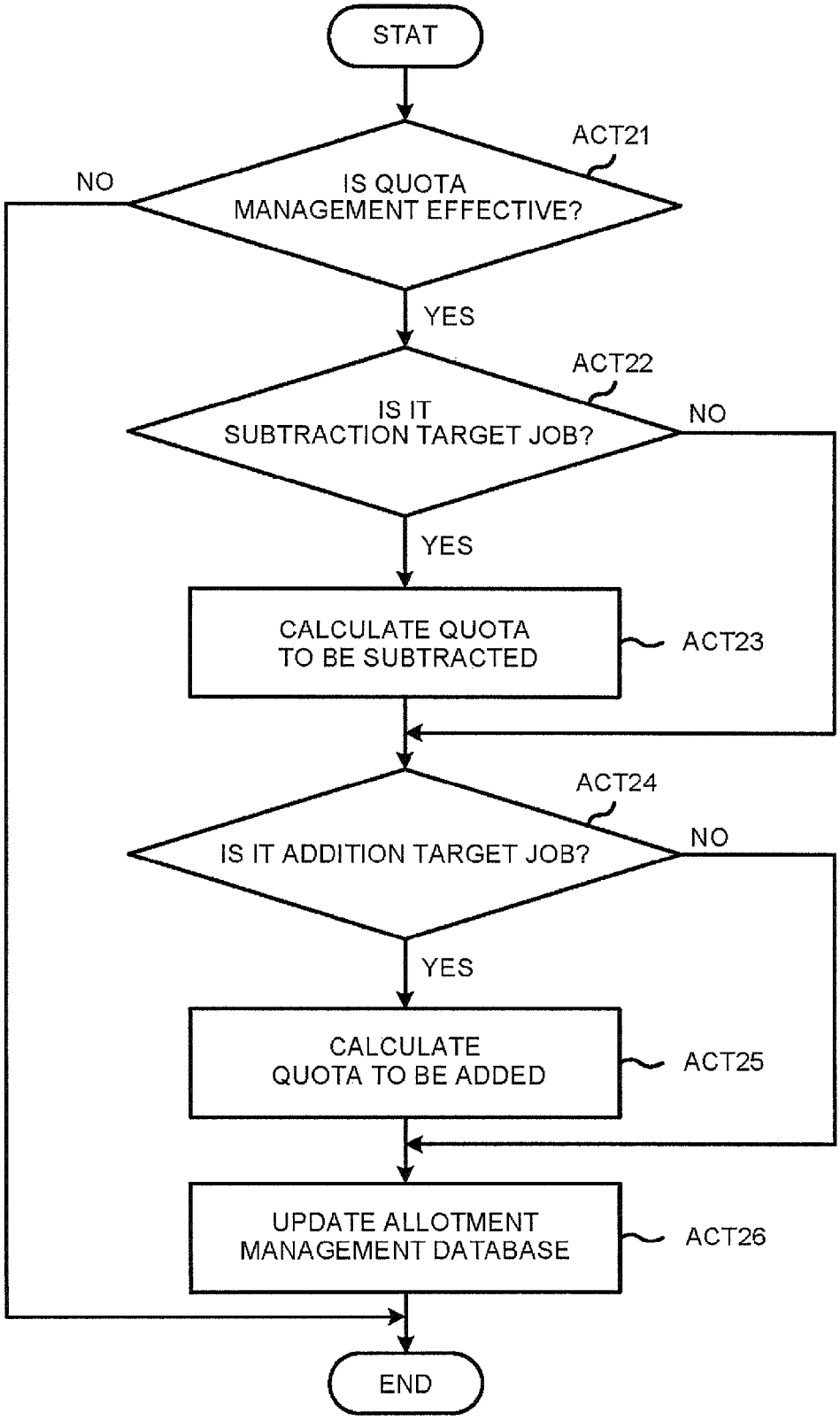
FIG. 12 is a flowchart illustrating a quota management operation carried out by an image forming apparatus when the execution of a job is ended according to the first embodiment.

FIG. 12 is a flowchart illustrating a quota management operation carried out by the image forming apparatus when the execution of a job is ended according to the first embodiment.

After 'end the job' is input, the control section 100 determines whether or not a quota management is effective with reference to the allotment management effective flag 150*m* in ACT 21.

The processing is ended if the quota management is not effective (NO in ACT 21). When the quota management is effective (YES in ACT 21), in ACT 22, the control section 100 determines whether not the executed job is a subtraction target job with reference to the function management database 150*b*.

The flow proceeds to ACT 24 if the job is not a subtraction target (NO in ACT 22). If the job is a subtraction target (YES in ACT 22), in ACT 23, the control section 100 calculates a quota to be subtracted with reference to the weighting setting tables 150*d*-150*f*.

In ACT 24, the control section 100 determines whether not the executed job is an addition target job with reference to the function management database 150*b*.

If the job is an addition target (YES in ACT 24), in ACT 25, the control section 100 calculates a quota to be added with reference to the weighting setting tables 150*j*-150*k*. In ACT 26, the control section 100 updates the accumulated subtraction value, the accumulated addition value and the current value in the allotment management database 150*c*. If the job is not an addition target (NO in ACT 24), in ACT 26, the control section 100 updates the accumulated subtraction value and the current value in the allotment management database 150*c*.

A Second Embodiment

Further, the operations of an image forming apparatus is described in the first embodiment, however, the present invention is not to this, an image forming system provided with a plurality of image forming apparatuses may be configured. The same parts in the first and the second embodiment are denoted by the same reference signs which are not described repeatedly here.

Figure 13:
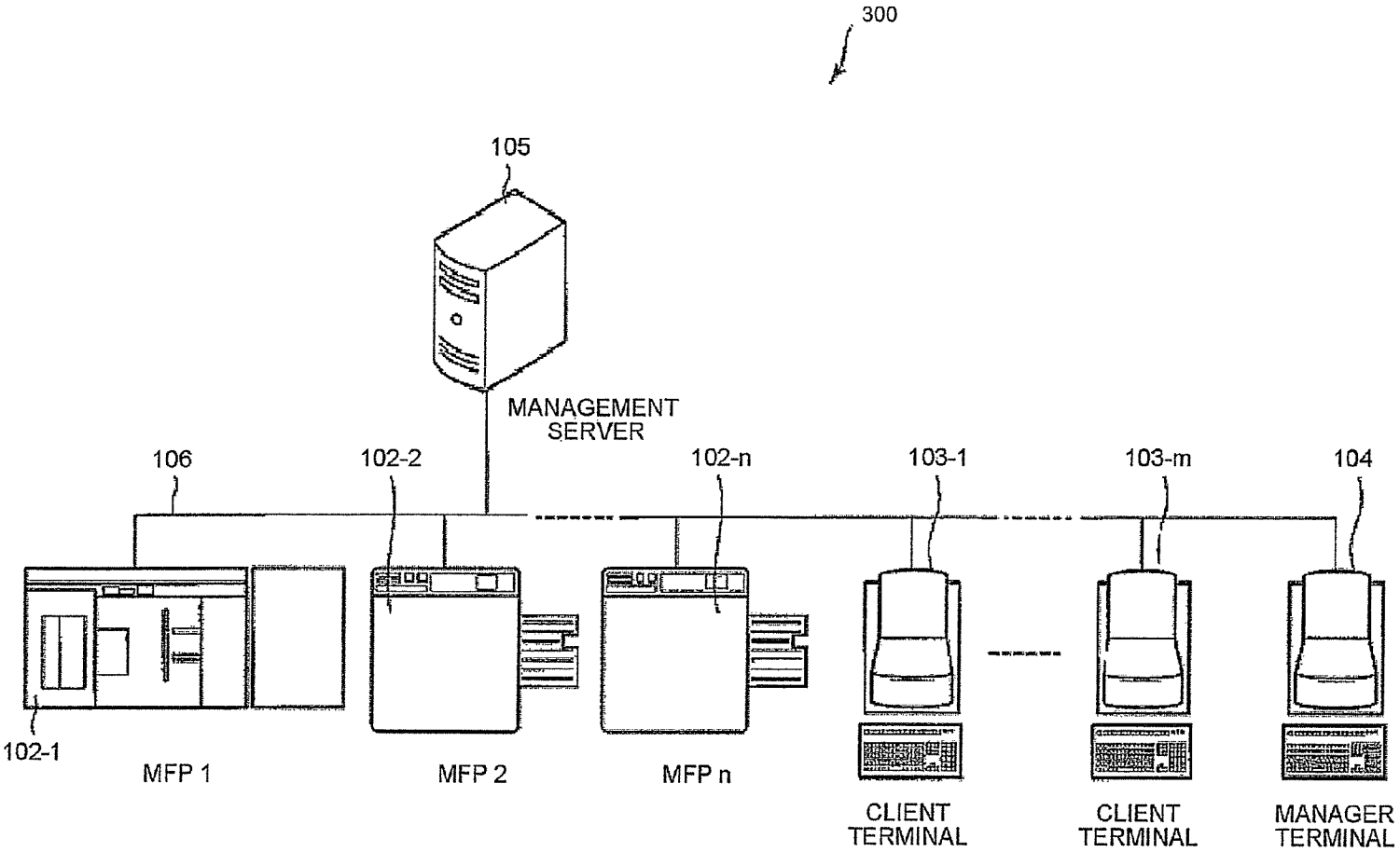
FIG. 13 is a diagram illustrating a constitution of an image forming system according to a second embodiment.

FIG. 13 is a diagram illustrating a constitution of an image forming system according to the second embodiment.

An image forming system 300 comprises at least one image forming apparatus 102 (102-1, 102-2 . . . 102-*n*), a client terminal 103 (103-1 . . . 103-*m*), a manager terminal 104 and a management server 105, which are connected with each other via a communication line 106.

The client terminal 103 is a user-owned information processing terminal which creates and sends image information and instruction information for printing carried out by the image forming apparatus 102. The manager terminal 104, which is an information processing terminal owned by a manager of the image forming system 300, creates and sends the management information relating to a quota management to the management server 105. The client terminal 103 and the manager terminal 104, which are not limited to information processing terminals of a stationary type, may further be a mobile PC (Personal Computer) or a portable terminal.

The management server 105 executes a quota management while storing the information relating to a user and executing a user authentication.

The communication line 106, which is a line widely used for receiving and sending information, is not limited to be wired communication using conductive line or optical fibers but can also be wireless communication using light, sound wave and electric wave.

Herein, the authentication section 100*a*, the function management section 100*b* and the allotment management section 100*c* shown in FIG. 6 for executing a quota management are arranged in the management server 105. Further, the authentication database 150*a*, the function management database 150*b*, the allotment management database 150*c*, the weighting setting tables 150*d*-150*k* and the allotment management effective flag 150*m* are arranged as databases relating to a quota management.

Further, the image forming apparatus 102 has a function of printing with a color erasable toner as well as a function of erasing the color of a reusable paper.

With such a constitution, the user, who is managed by a server and passes a use authentication, can use the functions of the image forming apparatus 102 permitted by the server within a quota set by the server. Further, the part used by the user is weighted in the server and subjected to addition and subtraction operations to manage the quota.

A Third Embodiment

In a third embodiment, it may be set that the color erasing function is separated from the image forming apparatus described the second embodiment, and an image forming system having a color erasing apparatus is set. The same parts in the first and the third embodiment are denoted by the same reference signs which are not described repeatedly here.

Figure 14:
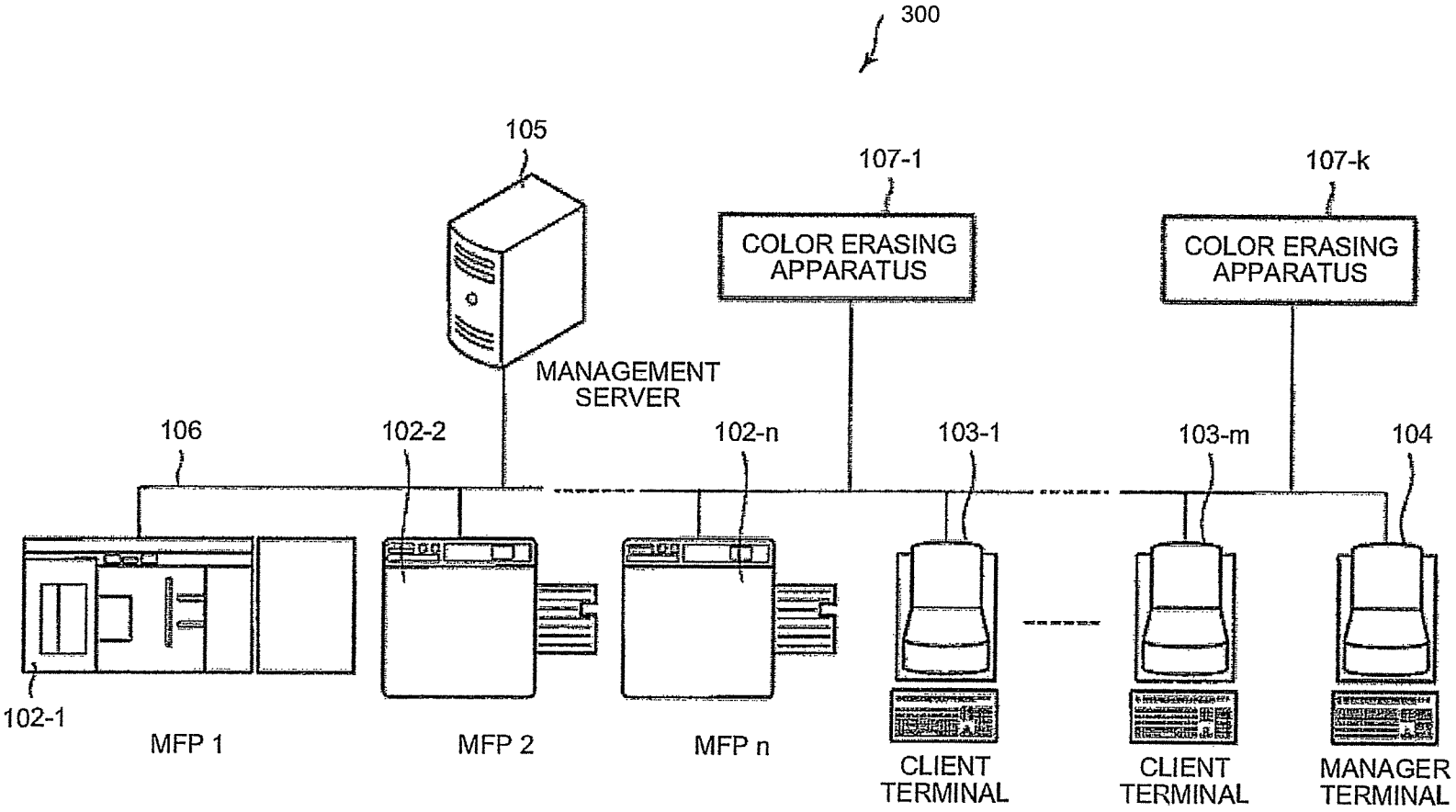
FIG. 14 is a diagram illustrating a constitution of an image forming system according to a third embodiment.

FIG. 14 is a diagram illustrating a constitution of an image forming system according to the third embodiment.

The image forming system 300 comprises at least one image forming apparatus 102 (102-1, 102-2 . . . 102-*n*), a client terminal 103 (103-1 . . . 103-*m*), a manager terminal 104, a management server 105 and a color erasing apparatus 107 (107-1 . . . 107-*k*), which are connected with each other via a communication line 106.

The color erasing apparatus 107 can send log information about when, which user erases how many pages to the management server 105. The management server 105 executes a quota addition operation for the user based on the information.

With the functions of each embodiment described above, an addition operation can be actively carried out for a quota, which promotes the contribution to ecology.

Further, in addition to the purpose of environment protection, the image forming apparatus described herein can be used for other specific purposes, for example, to strengthen and promote a cost management, it may be set that a quota is added when a specific operation (duplex printing or n-in-one printing and the like) is executed.

Further, the image forming apparatus described herein is not limited to use a color erasable toner and can also use a color inerasable toner.

Further, the functions described in the embodiments above may be realized using hardware, or be realized by loading a program recorded with the functions into a computer using software. Further, each function can be realized by selecting software or hardware as needed.

Further, each function may be realized by loading a program stored in a recording medium (not shown) into a computer. The form of the recording medium described in the embodiments herein is not limited as long as the recording medium can record a program and is readable by a computer.

In addition, the present invention is not limited to the above-described embodiments, and components may be modified and reified without departing from the spirit of the invention in other embodiment.

Furthermore, various inventions can be devised by combining a proper number of the components disclosed in the aforementioned embodiments. For example, several components may be deleted from the components disclosed in the aforementioned embodiments or components of different embodiments may be combined in a proper way.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

The invention claimed is:

1. An image forming apparatus, comprising:

an image forming section configured to form an image on a surface of a medium with a recording material the color of which cannot be erased by heating;

a heating section configured to heat the medium to fix the image;

a controller configured to:

determine whether a completed job is a quota subtraction target job or a quota addition target job;

calculate a corresponding subtraction quota when the job is a quota subtraction target job or a corresponding addition quota when the job is a quota addition target job; and update the current quota based on the subtraction quota and the addition quota.

2. The image forming apparatus according to claim 1, wherein the image forming section forms an image on the surface of the medium with a recording material the color of which can be erased by heating or a recording material the color of which cannot be erased by heating; and the fixing section heats the recording material the color of which can be erased by heating to erase the color.

3. The image forming apparatus according to claim 2, wherein the quota addition target job includes at least one of a job of erasing the color of a reusable paper on which an image is formed with a recording material the color of which can be erased by heating and a job of forming an image with a recording material the color of which can be erased by heating.

4. The image forming apparatus according to claim 2, wherein the completed job includes a job which is the quota subtraction target job and the quota addition target job.

5. The image forming apparatus according to claim 2, wherein the quota subtraction target job and the quota addition target job are set in advance for each user.

6. An image forming system comprising an image forming apparatus and a server which are connected with each other via a communication line, wherein the image forming apparatus comprising:

an image forming section configured to form an image on a surface of a medium with a recording material the color of which can be erased by heating or a recording material the color of which cannot be erased by heating; and a heating section configured to heat the medium to fix the image or to heat the recording material the color of which can be erased by heating to erase the color;

and the server comprising:

a memory configured to store computer executable instructions; and a processor configured to execute the computer executable instructions to perform operations comprising:

determining whether a job executed by the image forming apparatus is a quota subtraction target job or a quota addition target job;

calculating a corresponding subtraction quota when the job is a quota subtraction target job or a corresponding addition quota when the job is a quota addition target job; and updating the current quota based on the addition quota and the subtraction quota.

7. The image forming system according to claim 6, wherein the quota addition target job includes at least one of a job of erasing the color of a reusable paper on which an image is formed with a recording material the color of which can be erased by heating and a job of forming an image with a recording material the color of which can be erased by heating.

8. The image forming system according to claim 6, wherein the completed job includes a job which is the quota subtraction target job and the quota addition target job.

9. An image forming system comprising an image forming apparatus, a color erasing apparatus, and a server which are connected with each other via a communication line, wherein the image forming apparatus comprising:

an image forming section configured to form an image on a surface of a medium with a recording material the color of which cannot not be erased by heating; and a heating section configured to heat the medium to fix the image;

the color erasing apparatus comprising:

a heating section configured to heat a recording material the color of which can be erased by heating to erase the color;

and the server comprising:

a memory configured to store computer executable instructions; and a processor configured to execute the computer executable instructions to perform operations comprising:

determining whether a job executed by the image forming apparatus and the color erasing apparatus is a quota subtraction target job or a quota addition target job;

calculating a corresponding subtraction quota when the job is a quota subtraction target job or a corresponding addition quota when the job is a quota addition target job; and updating the current quota based on the addition quota and the subtraction quota.

10. The image forming system according to claim 9, wherein the quota addition target job includes at least one of a job of erasing the color of a reusable paper on which an image is formed with a recording material the color of which can be erased by heating and a job of forming an image with a recording material the color of which can be erased by heating.

* * * * *